US008448298B2

(12) United States Patent
Rothschild

(10) Patent No.: US 8,448,298 B2
(45) Date of Patent: May 28, 2013

(54) HANDLE ATTACHMENT FOR DOORKNOBS

(76) Inventor: John Jacob Rothschild, Louisville, KY (US)

( * ) Notice: Subject to any disclaimer, the term of this patent is extended or adjusted under 35 U.S.C. 154(b) by 105 days.

(21) Appl. No.: 13/136,584

(22) Filed: Aug. 5, 2011

(65) Prior Publication Data

US 2012/0054985 A1 Mar. 8, 2012

Related U.S. Application Data

(60) Provisional application No. 61/344,662, filed on Sep. 7, 2010.

(51) Int. Cl.
*A45C 3/00* (2006.01)

(52) U.S. Cl.
USPC ..... 16/413; 292/347; 292/348

(58) Field of Classification Search
USPC ..... 16/412–413
See application file for complete search history.

(56) References Cited

U.S. PATENT DOCUMENTS

| | | | | |
|---|---|---|---|---|
| 3,827,739 | A * | 8/1974 | Overholser | 292/347 |
| 4,397,489 | A | 8/1983 | Lind | |
| 4,504,087 | A * | 3/1985 | Pennington | 292/347 |
| 4,783,883 | A * | 11/1988 | Szalay | 16/412 |
| 5,288,116 | A | 2/1994 | Donofrio | |
| 5,638,576 | A * | 6/1997 | Mutone | 16/413 |
| 5,664,287 | A * | 9/1997 | Sendelbach | 16/412 |
| 6,447,031 | B1 * | 9/2002 | O'Hanlon | 292/348 |
| 6,751,827 | B1 | 6/2004 | Fok | |

* cited by examiner

*Primary Examiner* — Victor Batson
*Assistant Examiner* — Matthew Sullivan

(57) ABSTRACT

A device for providing a lever attachment to round doorknobs having a flexible cylindrical part that adapts to the majority of doorknobs of different diameters, thicknesses and profiles. During the screw tightening the compressible elastomeric material sandwiched between doorknob and cylindrical part of the attachment increases the interface contact surface to take the shape of the doorknob profile. The elastomeric insert has a high coefficient of friction. It prevents slipping of the attachment after tightening.

1 Claim, 3 Drawing Sheets

SECTION A – A

SECTION B – B

SECTION B – B

SECTION B – B

SECTION C – C

HANDLE ATTACHMENT FOR DOORKNOBS

CROSS-REFERENCE TO RELATED APPLICATIONS

Claiming priority to my earlier file application
Application No. 61/344,662
Filing Date: Sep. 7, 2010

BACKGROUND

1. Field of the Invention

The invention relates to a device that can be attached to doorknobs to make the doorknob easy to turn. The application is for persons suffering from arthritis or is otherwise handicapped, who lack the ability to grip and rotate the doorknob. The device permits to change from a hand gripping and wrist twisting action to a lever action.

2. Description of the Prior Art

Patents searched of prior arts lack the flexibility to adapt to door knobs of different diameters, thicknesses and profiles. Prior art patents are made of cast material and need various machining operations before the described devices can be installed. Patent searched U.S. Pat. Nos. 4,397,489 5,288,116 5,664,287 6,751,827

3. Advantages

The device has a low manufacturing costs, requires no machining operations and is of light weight. The device is suitable for mass production consisting of the use of a variety of sheet metal forming processes such as punching, blanking, bending flanging and spot welding. It is easy to install and remove without removing the doorknob from the door lock.

SUMMARY OF THE INVENTION

The present invention relates to a method and device for retrofitting a doorknob with a lever type handle. It modifies the opening or closing operation of a door lock from a gripping and twisting action to an easy to actuate lever action. The device of the present invention comprises a one piece metal lever attachment having a lever arm portion and a cylindrical receiving portion for the doorknob. The cylindrical portion has a diameter equal to fit the largest of doorknobs commercially available. During the screw tightening process the cylindrical portion deflects and adapts to the doorknob diameter. The compressible elastomeric material sandwiched between doorknob and cylindrical part of the attachment increases the interface contact surface and takes the shape of the doorknob profile. The elastomeric insert has a high coefficient of friction. It prevents slipping of the attachment after tightening.

DETAILED DESCRIPTION OF THE INVENTION

Figure 1:
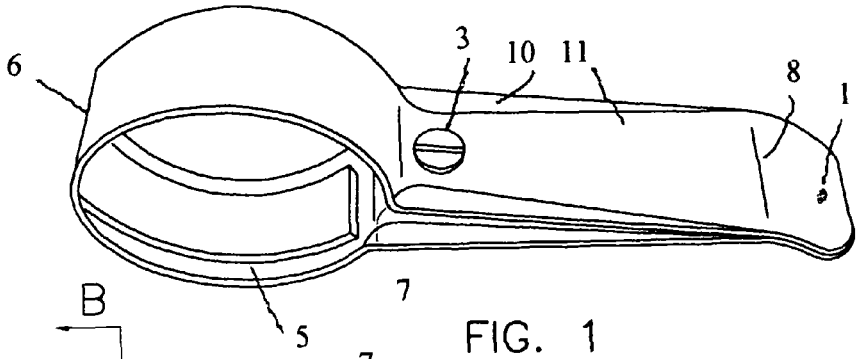
FIG. 1 is a perspective view of the door handle attachment.
Figure 5:
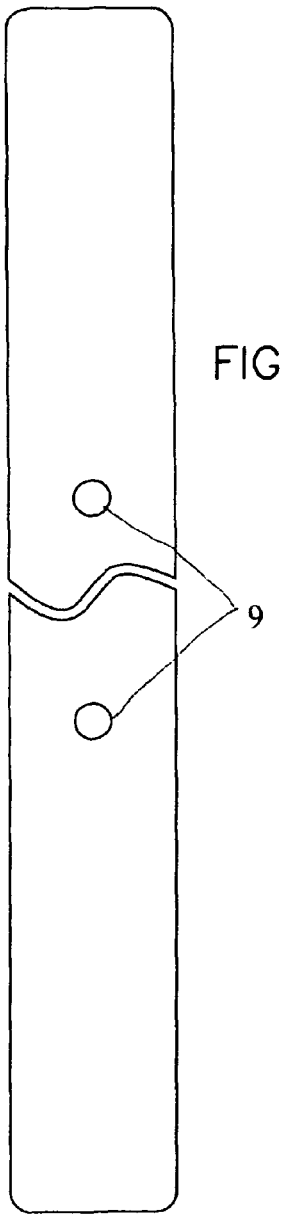
FIG. 5 is a blank for said handle.

Referring to the perspective view of FIG. 1 on sheet 1. The manufacturing process starts with the punch out of a blank FIG. 5 on sheet 2, including the punch out of two screw holes 9. This operation is followed by a press bending and forming process. To hold the end of lever 11 together a spot weld is applied at point 1. Clamping screw 3 and nut 4 are installed. Elastomeric strip 5 is fastened to the inside surface of the cylindrical portion 6 of the handle.

Figure 2:
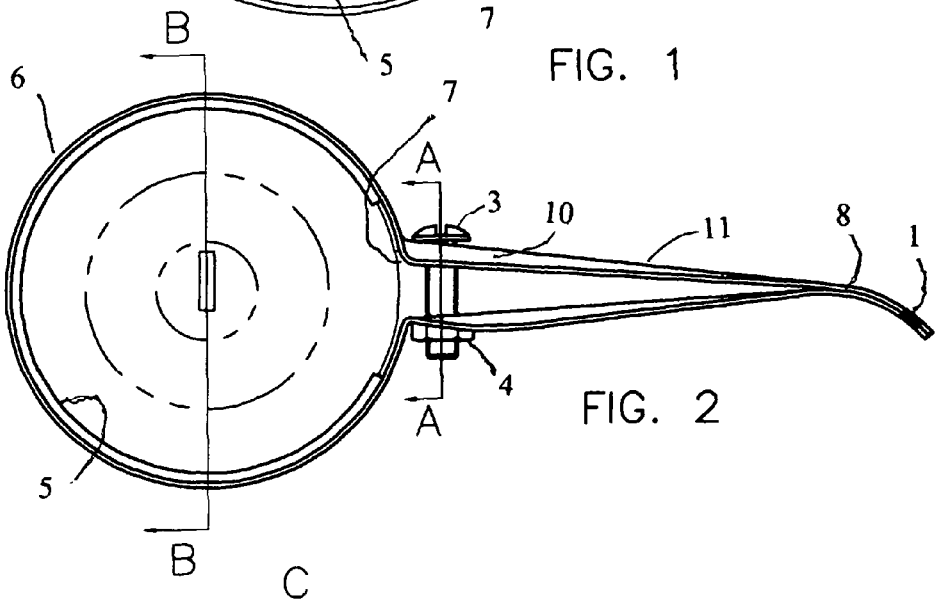
FIG. 2 is a front view of said handle attached to a round doorknob.
Figure 3:
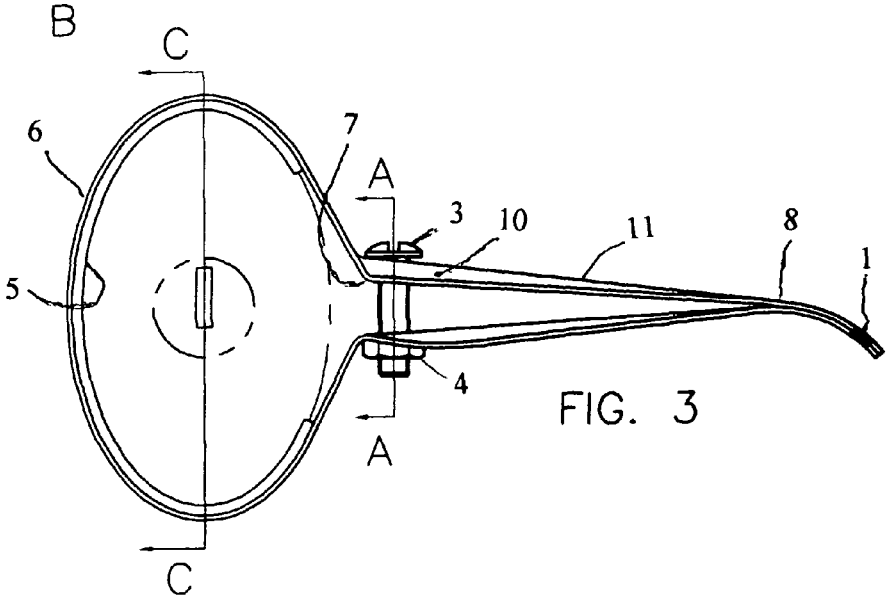
FIG. 3 is a front view of said handle attached to an oval doorknob.
Figure 4:
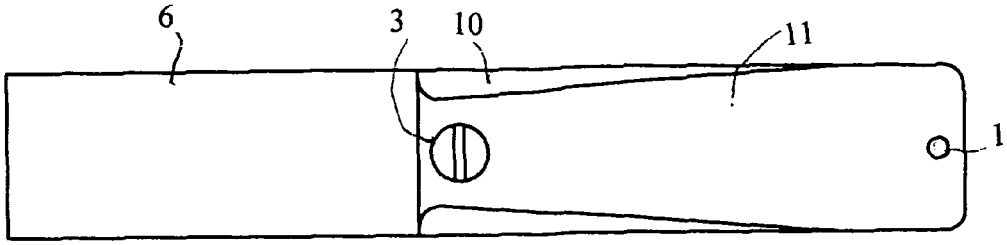
FIG. 4 is a top view of said handle.
Figure 6:
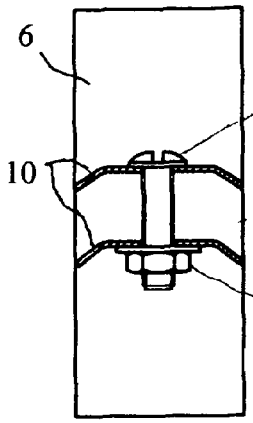
FIG. 6 is a cross section of the lever portion of said handle.
Figure 7:
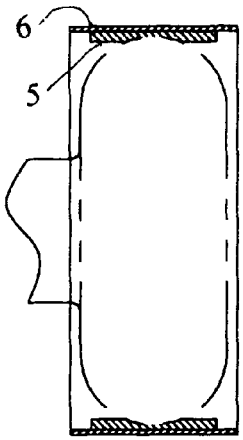
FIGS. 7 to 10 are cross sections of said handle clamped to four different configurations of doorknobs.
Figure 8:
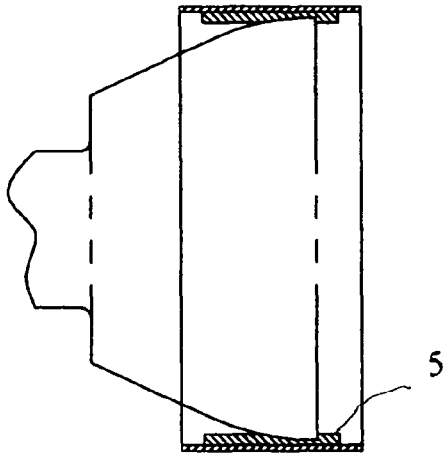
Figure 9:
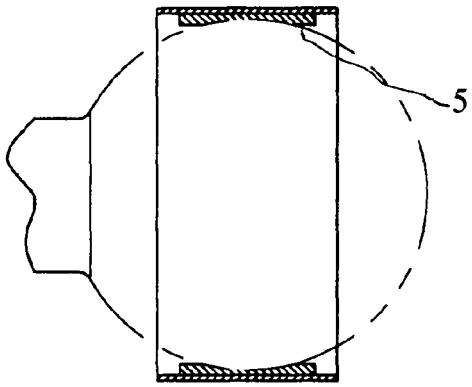
Figure 10:
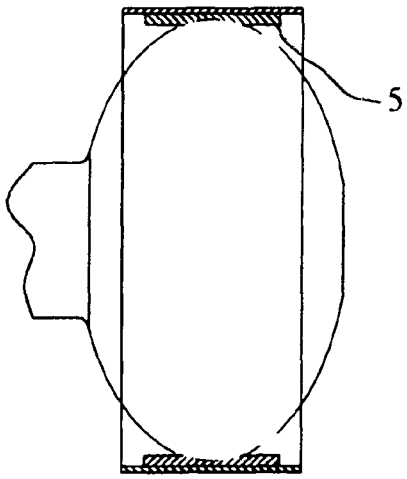

FIG. 6 on sheet 2 shows cross section A-A of lever 11 shown on FIGS. 2 & 3 on sheet 1. The bent down edges 10 of the upper and lower portion of the lever gives it the necessary rigidity against deflection. The edge length is at a maximum at the junction with the cylindrical part of the handle at bent 7 on FIGS. 2 & 3. where the maximum bending moment occurs. The size of the edge decreases to zero at line 8 shown on FIGS. 1, 2 & 3.

FIG. 2 on sheet 1 is a front view of the handle attached to a round doorknob. Before the installation of the handle the clamping screw 3 has to be loose in order to enable the circular part 6 of the handle to be spread and slid over the doorknob. Screw 3 is tightened until a firm grip is established. FIG. 3 shows the handle installed on an oval doorknob.

FIGS. 7 to 10 on sheets 2 & 3 show cross sections B-B and C-C of doorknobs FIGS. 2 & 3 on sheet 1. The cross sections show how the four doorknob profiles are imbedded in the elastomeric strip 5 upon tightening of screw 3

What is claimed is:

1. A one-piece auxiliary attachment handle for attaching to doorknobs comprising:

a flexible cylindrical receiving portion and a lever extending from the receiving portion;

the cylindrical receiving portion being an open loop comprising two ends, each one of the two ends defined by a bent section;

the lever comprising an upper lever portion and a lower lever portion;

wherein the upper lever portion extends from one said bent section of the open loop of the cylindrical portion and the lower lever portion extends from the other said bent section of the open loop of the cylindrical portion;

wherein the upper and lower lever portions extend in a direction away from the cylindrical receiving portion and converge to an end of the lever;

wherein the upper and lower lever portions are joined together at the end of the lever by spot welding;

wherein each of the upper and lower lever portions comprise two longitudinal sides, each of said sides has a bent down edge extending from the bent section towards the end of the lever portion to provide rigidity against deflection, each of the bent down edges comprising a width, said width is at a maximum at the bent section and decreases progressively to zero at the end of the lever portion;

wherein the handle further comprises a clamping screw and nut respectively attached to the upper and lower lever portions adjacent to the bent sections for adjusting the diameter of the cylindrical receiving portion;

wherein an elastomeric strip is fastened to the inside surface of the cylindrical portion of the handle to increase the contact surface and to prevent slipping of the handle upon a doorknob.

* * * * *